US011840924B2

(12) United States Patent
Jin et al.

(10) Patent No.: US 11,840,924 B2
(45) Date of Patent: Dec. 12, 2023

(54) SHORT AND WIDEBAND ISOLATOR FOR ACOUSTIC TOOLS

(71) Applicant: Halliburton Energy Services, Inc., Houston, TX (US)

(72) Inventors: Jing Jin, Singapore (SG); Chung Chang, Houston, TX (US); Gary Wayne Kainer, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/535,371

(22) Filed: Nov. 24, 2021

(65) Prior Publication Data

US 2023/0160302 A1 May 25, 2023

(51) Int. Cl.
*E21B 47/14* (2006.01)

(52) U.S. Cl.
CPC ..... *E21B 47/14* (2013.01)

(58) Field of Classification Search
None
See application file for complete search history.

(56) References Cited

U.S. PATENT DOCUMENTS

| | | | | |
|---|---|---|---|---|
| 9,448,320 | B2 | 9/2016 | Ratcliffe et al. | |
| 9,891,336 | B2 | 2/2018 | Chang et al. | |
| 2002/0157895 | A1* | 10/2002 | Dubinsky | G01V 1/523 181/102 |
| 2005/0279565 | A1 | 12/2005 | Arian et al. | |
| 2014/0177391 | A1 | 6/2014 | Sugiyama et al. | |
| 2015/0101800 | A1 | 4/2015 | Chang et al. | |
| 2015/0146501 | A1 | 5/2015 | Ratcliffe et al. | |
| 2016/0252639 | A1* | 9/2016 | Chang | G01V 1/46 367/25 |
| 2017/0299751 | A1 | 10/2017 | Chang et al. | |
| 2017/0371058 | A1 | 12/2017 | Li et al. | |
| 2020/0256185 | A1 | 8/2020 | Liu et al. | |
| 2021/0140301 | A1 | 5/2021 | Guner et al. | |
| 2021/0286096 | A1 | 9/2021 | Jin et al. | |
| 2023/0026433 | A1* | 1/2023 | Schimschal | E21B 47/16 |

FOREIGN PATENT DOCUMENTS

| | | |
|---|---|---|
| AU | 2004208724 | 11/2004 |

OTHER PUBLICATIONS

International Search Report and Written Opinion for Application No. PCT/US2021/061601, dated Aug. 9, 2022.

* cited by examiner

*Primary Examiner* — Curtis A Kuntz
*Assistant Examiner* — Jerold B Murphy
(74) *Attorney, Agent, or Firm* — John Wustenberg; C. Tumey Law Group PLLC

(57) ABSTRACT

An acoustic isolator and methods to the same. The acoustic isolator may comprise a body, one or more annular chambers formed inside the body of the acoustic isolator and positioned along a longitudinal axis of the acoustic isolator, an annular groove formed on an outer surface of the body of the acoustic isolator, and a passage disposed between the one or more annular chambers and the annular groove. The method may comprise transmitting an acoustic wave from a transmitter disposed on an acoustic logging tool into a subterranean formation, receiving an acoustic signal from the subterranean formation with a receiver disposed on the acoustic logging tool, and attenuating a second acoustic wave that moves between the transmitter and the receiver and through an acoustic isolator.

18 Claims, 4 Drawing Sheets

SHORT AND WIDEBAND ISOLATOR FOR ACOUSTIC TOOLS

BACKGROUND

For oil and gas exploration and production, a network of wells, installations and other conduits may be established by connecting sections of metal pipe together. For example, a well installation may be completed, in part, by lowering multiple sections of metal pipe (i.e., a casing string) into a wellbore, and cementing the casing string in place. In some well installations, multiple casing strings are employed (e.g., a concentric multi-string arrangement) to allow for different operations related to well completion, production, or enhanced oil recovery (EOR) options. From time to time, well installations and the subterranean formation in which the well installations are installed may be analyzed through measurement operations for any number of downhole operations. In some measurement operations, acoustic logging tools may be utilized.

Acoustic togging tools may be used to measure acoustic properties of a subterranean formations from which images, mechanical properties or other characteristics of the formations may be derived. Acoustic energy is generated by the acoustic logging tool and acoustic waves comprising periodic vibrational disturbances resulting from the acoustic energy propagating through the formation or the acoustic togging system are received by a receiver in the acoustic logging tool. Acoustic waves may be characterized in terms of their frequency, amplitude and speed of propagation. Acoustic properties of interest for formations may comprise compressional wave speed, shear wave speed, surface waves speed (e.g., Stoneley waves) and other properties. Acoustic images may be used to depict borehole wall conditions and other geological features away from the borehole. The acoustic measurements have applications in seismic correlation, petrophysics, rock mechanics and other areas. Acoustic measurements and thus acoustic images may be susceptible to direct coupling between the transmitter and receiver on the acoustic logging tool, which may degrade the acoustic image.

As the transmitter and receivers are physically connected by the tool body, direct coupling is acoustic waves propagating between the transmitter and receivers, at the speed of sound in the body of the acoustic logging tool. This speed of sound is much faster in solids, such as the body of the acoustic logging tool, other than that of the borehole fluids. Hence the acoustic waves traveling through the body will be received by the receivers earlier than the desired signals from the casing or borehole and overlay onto the latter. This phenomenon, direct coupling, is the common challenge to acoustic tools. An effective operation of the acoustic logging tools may be hindered by undesirable noise signals encountered downhole by the logging tools.

BRIEF DESCRIPTION OF THE DRAWINGS

These drawings illustrate certain aspects of some examples of the present disclosure and should not be used to limit or define the disclosure.

DETAILED DESCRIPTION

This disclosure may generally relate to system and methods for an acoustic isolator disposed on a conveyance. The acoustic isolator may reduce the acoustic energy transferred through the body of the acoustic logging tool. This may reduce and/or prevent direct coupling between acoustic transmitters and acoustic receivers on the acoustic logging tool.

Figure 1:
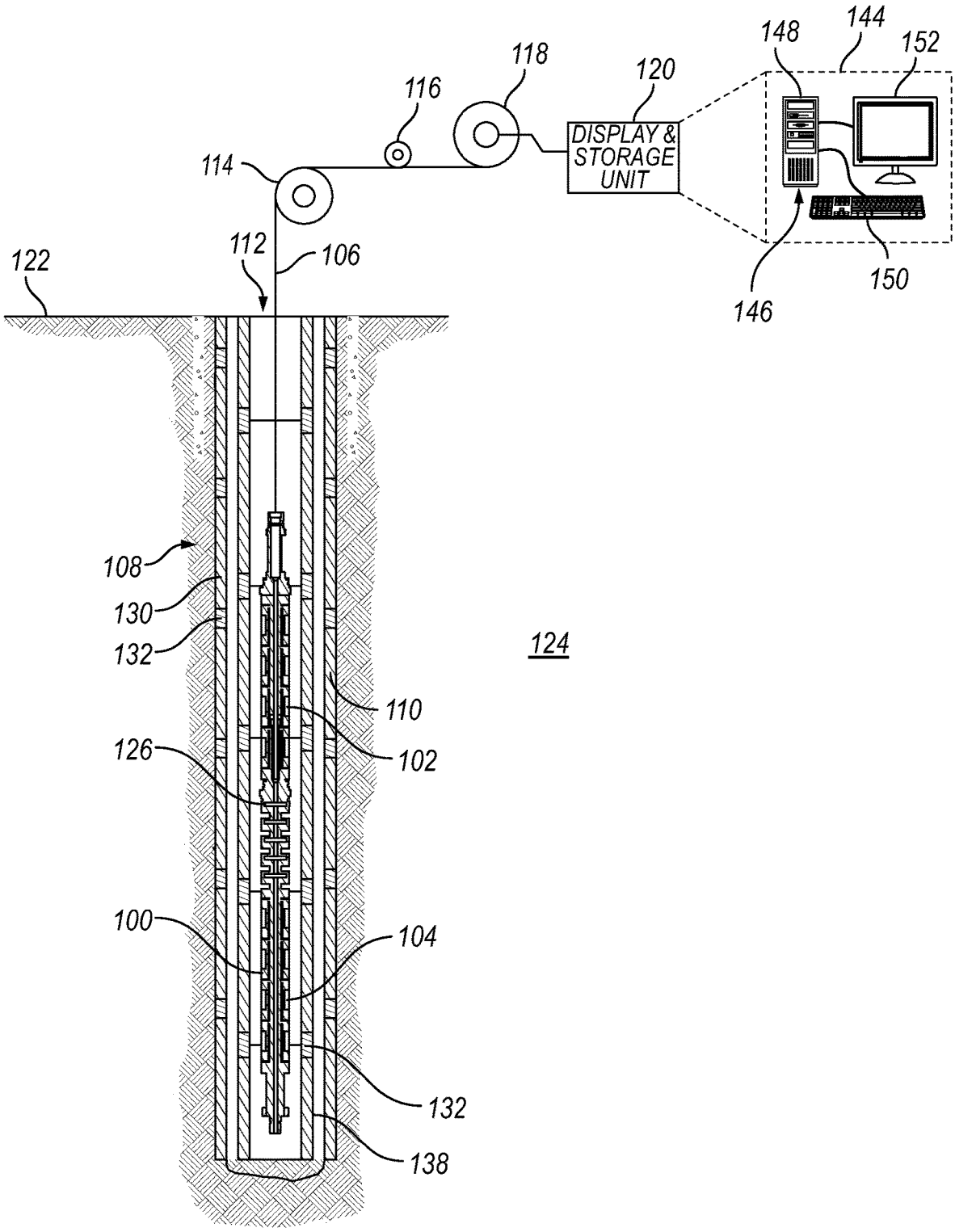
FIG. 1 illustrates a system including an acoustic logging tool.

FIG. 1 illustrates an operating environment for an acoustic logging tool 100 as disclosed herein. Acoustic logging tool 100 may comprise a transmitter 102 and/or a receiver 104 that may be separated by an acoustic isolator 126. In examples, there may be any number of transmitters 102, any number of receivers 104, and/or any number of acoustic isolators 126, which may be disponed on acoustic logging tool 100. Acoustic logging tool 100 may be operatively coupled to a conveyance 106 (e.g., wireline, slickline, coiled tubing, pipe, downhole tractor, and/or the like) which may provide mechanical suspension, as well as electrical connectivity, for acoustic logging tool 100. Conveyance 106 and acoustic logging tool 100 may extend within casing string 108 to a desired depth within the wellbore 110. Conveyance 106, which may comprise one or more electrical conductors, may exit wellhead 112, may pass around pulley 114, may engage odometer 116, and may be reeled onto winch 118, which may be employed to raise and lower the tool assembly in the wellbore 110. Signals recorded by acoustic logging tool 100 may be stored on memory and then processed by display and storage unit 120 after recovery of acoustic logging tool 100 from wellbore 110. Alternatively, signals recorded by acoustic logging tool 100 may be conducted to display and storage unit 120 by way of conveyance 106. Display and storage unit 120 may process the signals, and the information contained therein may be displayed for an operator to observe and stored for future processing and reference. Alternatively, signals may be processed downhole prior to receipt by display and storage unit 120 or both downhole and at surface 122, for example, by display and storage unit 120. Display and storage unit 120 may also contain an apparatus for supplying control signals and power to acoustic logging tool 100. Typical casing string 108 may extend from wellhead 112 at or above ground level to a selected depth within a wellbore 110. Casing string 108 may comprise a plurality of joints 130 or segments of casing string 108, each joint 130 being connected to the adjacent segments by a collar 132.

FIG. 1 also illustrates a typical pipe string 138, which may be positioned inside of casing string 108 extending part of the distance down wellbore 110. Pipe string 138 may be production tubing, tubing string, casing string, or other pipe disposed within casing string 108. Pipe string 138 may comprise concentric pipes. It should be noted that concentric pipes may be connected by collars 132. Acoustic logging tool 100 may be dimensioned so that it may be lowered into the wellbore 110 through pipe string 138, thus avoiding the difficulty and expense associated with pulling pipe string 138 out of wellbore 110.

In logging systems, such as, for example, logging systems utilizing the acoustic logging tool 100, a digital telemetry system may be employed, wherein an electrical circuit may be used to both supply power to acoustic logging tool 100 and to transfer data between display and storage unit 120 and acoustic logging tool 100. A DC voltage may be provided to acoustic logging tool 100 by a power supply located above ground level, and data may be coupled to the DC power conductor by a baseband current pulse system. Alternatively, acoustic logging tool 100 may be powered by batteries located within the downhole tool assembly, and/or the data provided by acoustic logging tool 100 may be stored within the downhole tool assembly, rather than transmitted to the surface during logging (corrosion detection).

Acoustic logging tool 100 may be used for excitation of transmitter 102. As illustrated, one or more receiver 104 may be positioned on the acoustic logging tool 100 at selected distances (e.g., axial spacing) away from transmitter 102. The axial spacing of receiver 104 from transmitter 102 may vary, for example, from about 0 inches (0 cm) to about 40 inches (101.6 cm) or more. In some embodiments, at least one receiver 104 may be placed near the transmitter 102 (e.g., within at least 1 inch (2.5 cm) while one or more additional receivers may be spaced from 1 foot (30.5 cm) to about 5 feet (152 cm) or more from the transmitter 102. It should be understood that the configuration of acoustic logging tool 100 shown on FIG. 1 is merely illustrative and other configurations of acoustic logging tool 100 may be used with the present techniques. In addition, acoustic logging tool 100 may comprise more than one transmitter 102 and more than one receiver 104. For example, an array of receivers 104 may be used. Transmitters 102 may comprise any suitable acoustic source for transmitting (i.e., generating) acoustic waves downhole, including, but not limited to, monopole and multipole sources (e.g., dipole, cross-dipole, quadrupole, hexapole, or higher order multipole transmitters). Additionally, one or more transmitters 102 (which may comprise segmented transmitters) may be combined to excite a mode corresponding to an irregular/arbitrary mode shape. Specific examples of suitable transmitters 102 may comprise, but are not limited to, piezoelectric elements, bender bars, or other transducers suitable for generating acoustic waves downhole. Receiver 104 may comprise any suitable acoustic receiver suitable for use downhole, including piezoelectric elements that may convert acoustic waves into an electric signal.

Transmission of acoustic waves by the transmitter 102 and the recordation of signals by receivers 104 may be controlled by display and storage unit 120, which may comprise an information handling system 144. As illustrated, the information handling system 144 may be a component of the display and storage unit 120. Alternatively, the information handling system 144 may be a component of acoustic logging tool 100. An information handling system 144 may comprise any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, an information handling system 144 may be a personal computer, a network storage device, or any other suitable device and may vary in size, shape, performance, functionality, and price. Information handling system 144 may comprise a processing unit 146 (e.g., microprocessor, central processing unit, etc.) that may process EM log data by executing software or instructions obtained from a local non-transitory computer readable media 148 (e.g., optical disks, magnetic disks). The non-transitory computer readable media 148 may store software or instructions of the methods described herein. Non-transitory computer readable media 148 may comprise any instrumentality or aggregation of instrumentalities that may retain data and/or instructions for a period of time. Non-transitory computer readable media 148 may comprise, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing. Information handling system 144 may also comprise input device(s) 150 (e.g., keyboard, mouse, touchpad, etc.) and output device(s) 152 (e.g., monitor, printer, etc.). The input device(s) 150 and output device(s) 152 provide a user interface that enables an operator to interact with acoustic logging tool 100 and/or software executed by processing unit 146. For example, information handling system 144 may enable an operator to select analysis options, view collected log data, view analysis results, and/or perform other tasks As noted above and illustrated in FIG. 1, transmitters 102 and receivers 104 are physically connected by the tool body of acoustic logging tool 100. During measurement operations, transmitter 102 may transmit one or more acoustic waves, as discussed above. At least a part of these acoustic waves may propagate between transmitter 102 and receivers 104 through the tool body of acoustic logging tool 100, this is defined as direct coupling. The acoustic waves may propagate at the speed of sound through the tool material, which may be, for example, steel. The speed of sound through a solid material, such as steel, is much faster than that of the speed of sound through liquids, such as borehole fluids. Thus, acoustic waves may be received by receivers 104 earlier than the desired acoustic signals that may have propagated though casing string 108, wellbore 110, and/or pipe string 138. Acoustic isolator 126 may operate and function to prevent direct coupling between transmitter 102 and receiver 104 through a variety of mechanisms.

Figure 2:
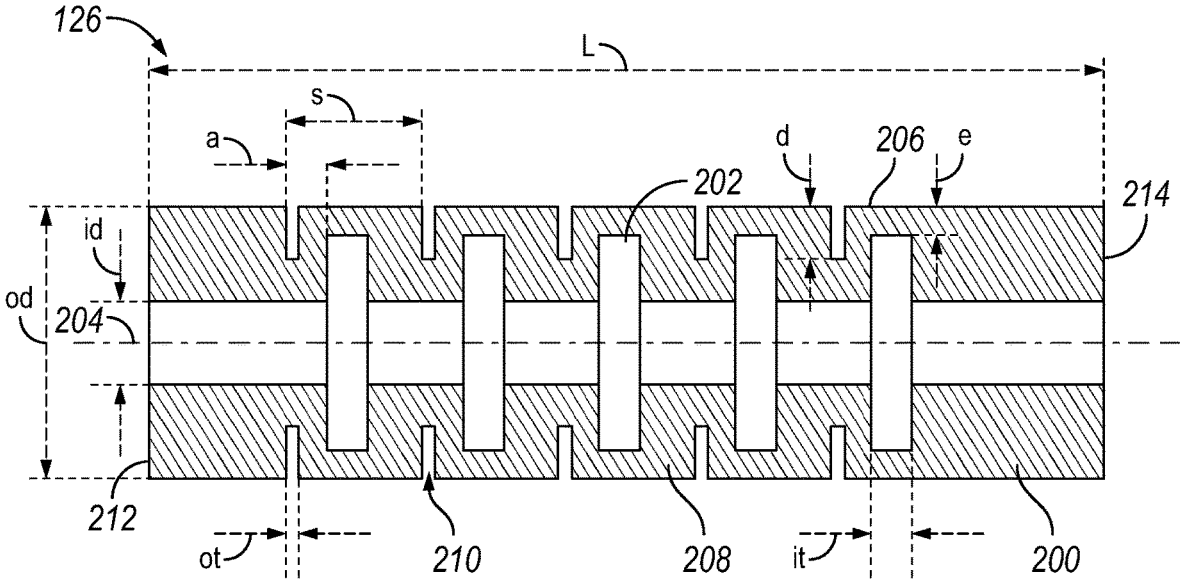
FIG. 2 illustrates a cross sectional view of an acoustic isolator.

FIG. 2 illustrates a cut away view of acoustic isolator 126. Acoustic isolator 126 may decrease (e.g., minimize or eliminate) undesirable acoustic signals propagated through acoustic logging tool 100, e.g., the tool mode. Additionally, acoustic isolator 126 may be implemented in any application in which acoustic waves transmitted between a transmitter 102 and receiver 104 (e.g., referring to FIG. 1) fixed longitudinally apart on the same tool body, are to be isolated. Implementing the techniques described here may increase an efficiency of acoustic isolator 126 and reduce a length of the tool resulting in increase in production speed, decrease in production cost, decrease in manufacturing issues and increase in log data quality. The reduced tool mode may also increase the range of formation slowness that acoustic isolator 126 may measure (e.g., formation with faster compressional and shear wave speed). As illustrated, acoustic isolator 126 comprises annular chambers 202 formed in acoustic isolator body 200 of acoustic isolator 126. Annular chambers 202 may be positioned along longitudinal axis 204 of acoustic isolator 126. The size, position, and number of annular chambers 202 in acoustic isolator 126 may be selected to attenuate acoustic energy across a selected frequency range. The creation of the inner and outer grooves for the isolator may be done by conventional machining. It also can be done via 3D print technology, in which the isolator, sometimes including the transmitter and receiver sections, can be directly printed out.

FIG. 2 further illustrates acoustic isolator 126 that has cut acoustic isolator body 200 from both inside and outside, to create both annular chambers 202 and annular grooves 210. In examples, acoustic isolator 126 may range in length from about 2" to about one foot (about 5 cm to about 31 cm). As noted above, annular chambers 202 are cut inside of acoustic isolator body 200 and annular grooves 210 are cut on outer surface 206 of acoustic isolator body 200. The creation of annular chambers 202 inside of acoustic isolator body 200 and annular grooves 210 outside of acoustic isolator body 200 may be performed by conventional machining. In other examples, annular chambers 202 and annular grooves 210 may be formed via 3D print technology, in which acoustic isolator 126, sometimes including the transmitter and receiver sections, may be directly printed out. In examples, acoustic isolator body 200 comprises at least one pair of annular chamber 202 and annular groove 210. This may create a passage 208 in acoustic isolator body 200. Passage 208 may form a zigzag path in which acoustic waves may travel. Passage 208 may attenuate acoustic energy and thus may prevent acoustic waves from traversing through the entire length of acoustic isolator 126.

Figure 3:
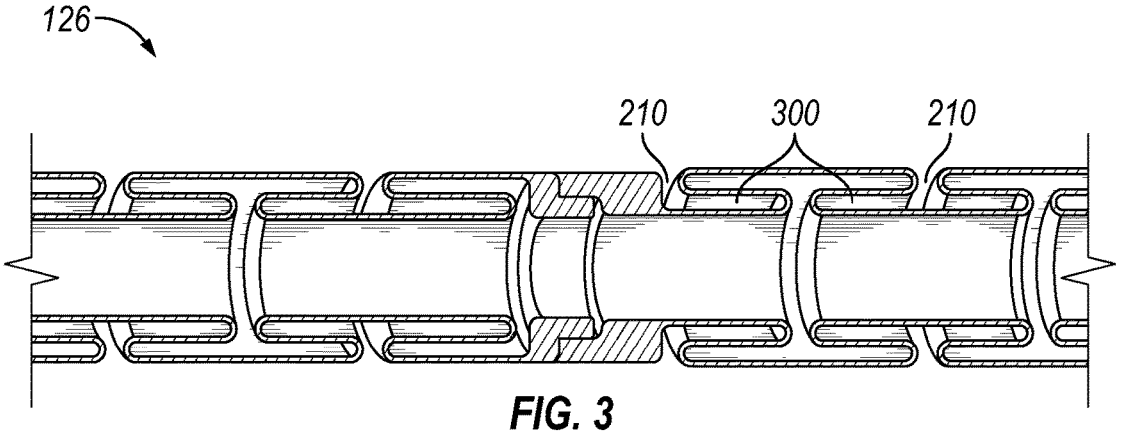
FIG. 3 illustrates a cross sectional view of another acoustic isolator.
Figure 4A:
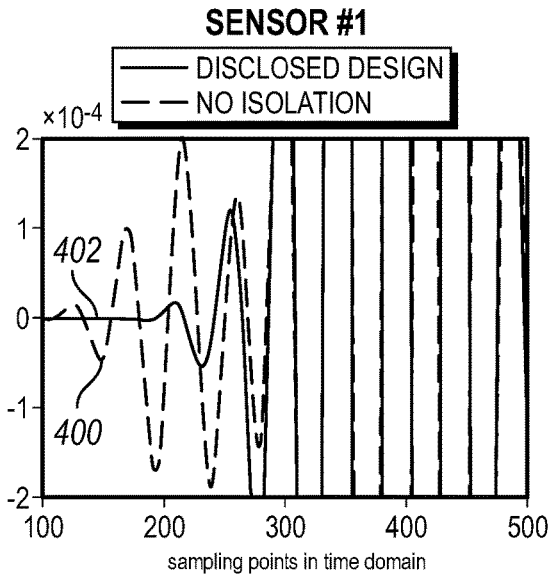
FIGS. 4A-4D are graphs illustrating acoustic energy attenuation for low frequencies with and without an acoustic isolator.
Figure 4B:
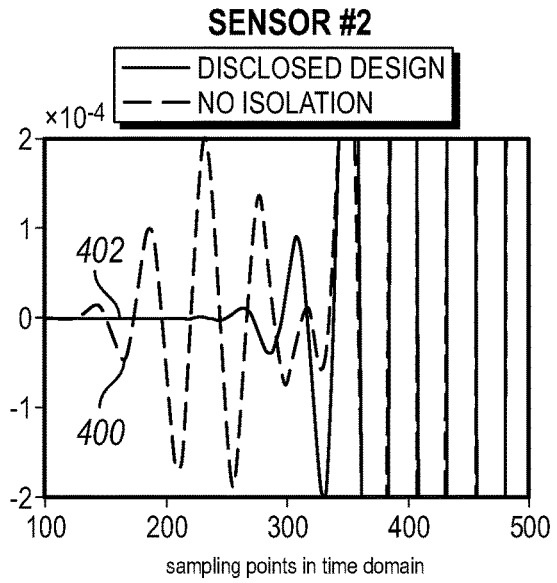
Figure 4C:
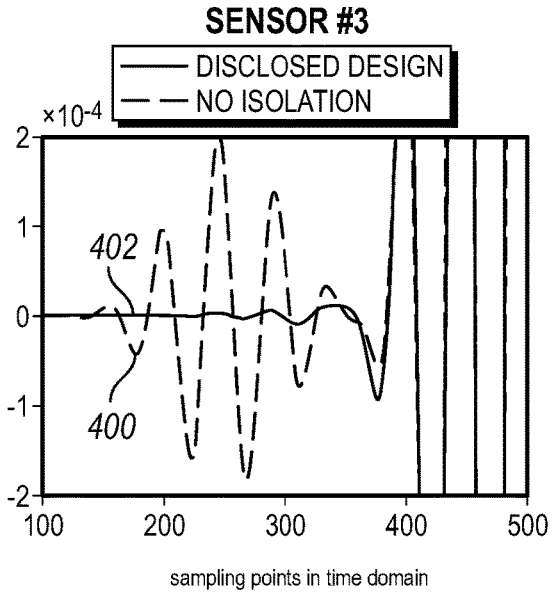
Figure 4D:
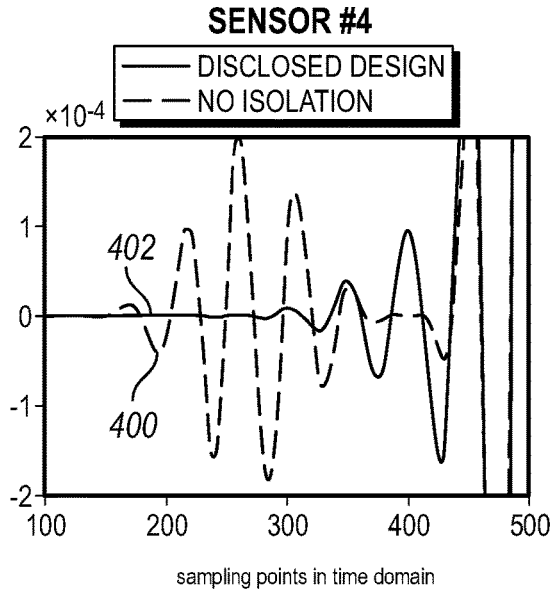
Figure 5A:
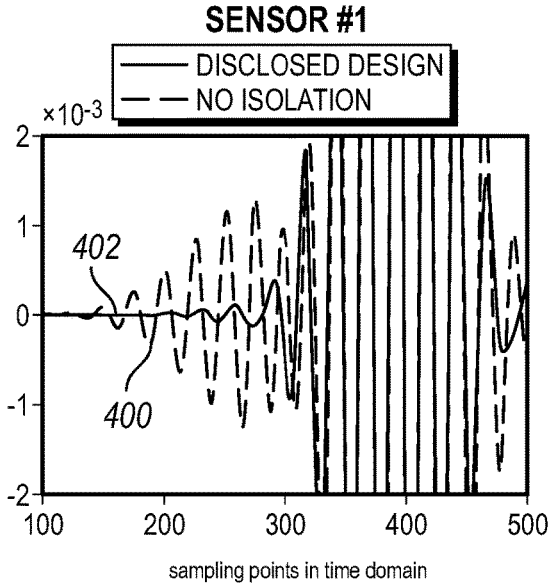
FIGS. 5A-5D are graphs illustrating acoustic energy attenuation for high frequencies with and without an acoustic isolator.
Figure 5B:
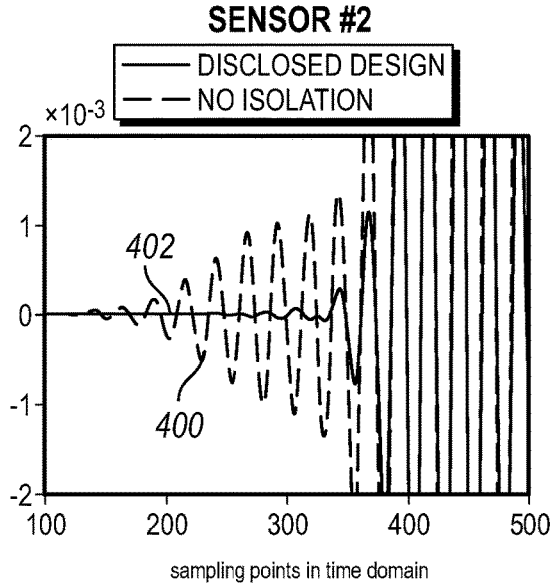
Figure 5C:
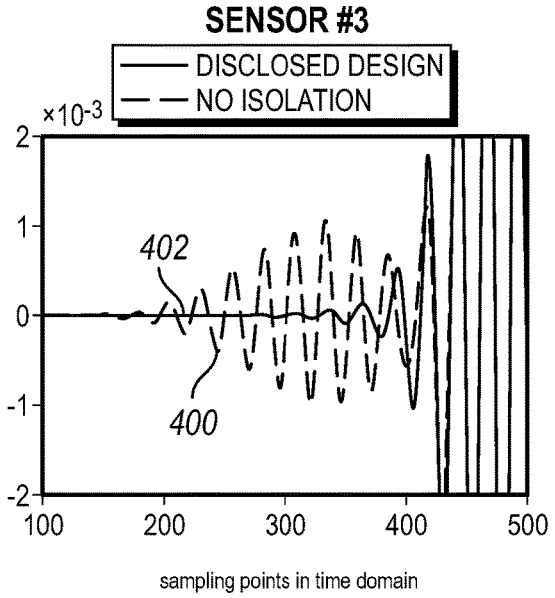
Figure 5D:
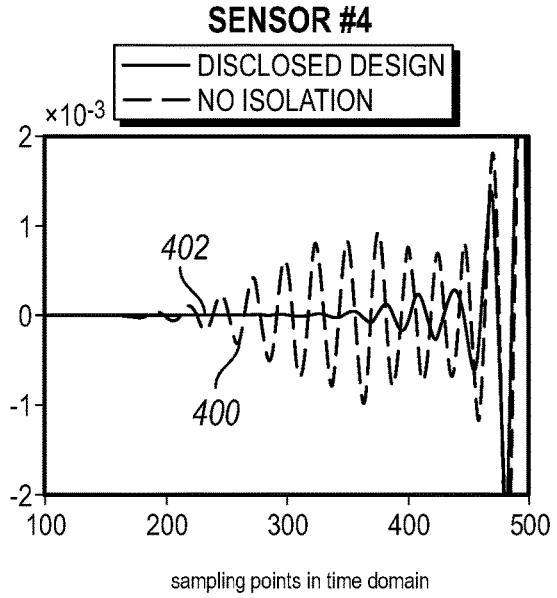

Annular groove 210 may be formed to take many different shapes and/or sizes. For example, annular groove 210 may be formed perpendicular and/or parallel to outer surface 206, as illustrated in FIG. 2, or may be formed at an angle to outer surface 206. Additionally, as illustrated in FIG. 3, annular groove 210 may comprise horizontal annular grooves 300, which may range from about 0" to about 5" (about 0 cm to about 13 cm) and may extend the length of passage 208 and may further help in attenuating acoustic energy from acoustic waves. Referring back to FIG. 2, annular groove 210 may have a depth d that may range from about 0.1" to about 3" (about 0.25 cm to about 8 cm) and may allow for acoustic isolator 126 to maintain mechanical strength. Width of annular groove 210, ot, may be about 0.1" and range from about 0.01" to about 3" (about 0.25 cm to about 8 cm), to minimize the strength reduction on acoustic isolator 126 and reduce the overall length of acoustic isolator 126. The width of annular chambers 202, it, may be larger than, ot, but may be about 0.3" and range from about 0.1" to about 2" to keep acoustic isolator 126 short. Additionally, spacing, a, between annular chamber 202 and annular groove 210 may be about 0.3" and range from about 0.1" to about 2" (about 0.25 cm to about 5 cm), which may narrow passage 208 and further help attenuate acoustic waves that may travers through passage 208. In examples, depth of annular groove 210, d, may be equal or larger than surface depth, e, of outer surface 206. This may also narrow passage 208 and further help attenuate acoustic waves that may travers through passage 208. As noted above, there may be a plurality of annular grooves 210 disposed across the length of acoustic isolator 126. In examples, annular grooves 210 may be disposed between each annular chamber 202. However, there may be multiple annular grooves 210 disposed between each annular chamber 202. Additionally, zero, one, or a plurality of annular grooves 210 may be disposed between an annular chamber 202 and either a first end 212 or second end 214 of acoustic isolator 126. Distance, s, between each annular groove 210 may be equal between each annular groove 210 and/or may vary between each annular groove 210. In examples, distance, s, may be about 1" (about 2.5 cm) and may range from about 0.3" to about 2" (about 0.75 cm to about 5 cm), which may allow for acoustic isolator 126 to remain shorter in overall length, l. Although not illustrates, acoustic isolator 126 may be housed in a sleeve to prevent borehole fluid from entering any of annular grooves 210. However, in examples, annular grooves 210 may fill with downhole fluid, tool oil, formation fluid, and/or the like, which may assist in attenuation of acoustic energy.

FIGS. 4A-4D are graphs of simulated data to show acoustic energy reduction utilizing the design of acoustic isolator 126 show in FIGS. 2 and 3. FIGS. 4A-4D illustrate acoustic energy, first wavelet 400 of an acoustic waves illustrates the acoustic energy without acoustic isolator 126. Utilizing acoustic isolator 126 of about 6" in length, acoustic energy may be reduced significantly, or more than 30 dB in this case. FIGS. 4A-4D illustrate comparisons of first wavelet 400 and second wavelet 402. Second wavelet 402 illustrates acoustic energy using acoustic isolator 126. Each graph in FIGS. 4A-4D may comprise an input signal is at 10 to 30 kHz, where the horizontal axis is sampling points in time domain, and the vertical axis is amplitude of the received signals. As noted above, acoustic isolator 126 may comprise passage 208 (e.g., referring to FIG. 2) that may form a zigzag path. This type of path may allow be effective for higher frequency.

FIGS. 5A-5D, illustrate acoustic energy, first wavelet 500 of an acoustic waves illustrates the acoustic energy without acoustic isolator 126. Utilizing acoustic isolator 126 of about 6" in length, acoustic energy may be reduced significantly, or more than 30 dB in this case. FIGS. 5A-5D illustrate comparisons of first wavelet 500 and second wavelet 502. Second wavelet 502 illustrates acoustic energy using acoustic isolator 126. Each graph in FIGS. 5A-5D may comprise an input signal is at 30 to 50 kHz, where the horizontal axis is sampling points in time domain, and the vertical axis is amplitude of the received signals. As noted above, acoustic isolator 126 may comprise passage 208 (e.g., referring to FIG. 2) that may form a zigzag path. This type of path may allow be effective for attenuation of higher frequency.

Although acoustic energy attenuation may be achieved via a short acoustic isolator 126, for example, from about 2" to about one foot (about 5 cm to about 31 cm), a longer acoustic isolator 126 may be used by using the disclosed design, with both annular chambers 202 and annular grooves 210 to create zigzag passage 208 for acoustic energy to traverse. Additionally, annular grooves 210 may be filled with other material, for example, plastics, rubber, tungsten rubber composite.

Improvements over current technology comprise methods and systems that may incorporate annular chambers and annular grooves as described above. Utilizing annular chambers and annular grooves may form zigzag passage for acoustic energy to traverse. The methods and system above may attenuate acoustic energy over short sections of an acoustic isolator. In examples, acoustic isolator may range in length from about 2" to about one foot (about 5 cm to about 31 cm), while current technology requires acoustic isolators may are over a foot in length (31 cm). In addition, this methods and systems may operate to attenuate acoustic energy in a wideband frequency. The systems and methods disclosed herein may comprise any of the various features of the systems and methods disclosed herein, including one or more of the following statements.

Statement 1: An acoustic isolator may comprise a body, one or more annular chambers formed inside the body of the acoustic isolator and positioned along a longitudinal axis of the acoustic isolator, an annular groove formed on an outer surface of the body of the acoustic isolator, and a passage disposed between the one or more annular chambers and the annular groove.

Statement 2. The acoustic isolator of statement 1, wherein the passage is a zigzag passage between the one or more annular chambers and the annular groove.

Statement 3. The acoustic isolator of any preceding statements 1 or 2, wherein the annular groove is disposed between a first annular chamber and a second annular chamber.

Statement 4. The acoustic isolator of any preceding statements 1-3, wherein the annular groove is disposed between a first end of the acoustic isolator and the one or more annular chambers.

Statement 5. The acoustic isolator of statement 4, wherein the annular groove is disposed between a second end of the acoustic isolator and the one or more annular chambers.

Statement 6. The acoustic isolator of any preceding statements 1-4, wherein the annular groove is perpendicular to the outer surface of the body of the acoustic isolator.

Statement 7. The acoustic isolator of statement 6, wherein the annular groove comprises one or more horizontal annular grooves.

Statement 8. The acoustic isolator of any preceding statements 1-4 or 6, wherein the annular groove is angled to the outer surface of the of the body of the acoustic isolator.

Statement 9. The acoustic isolator of statement 8, wherein the annular groove comprises one or more horizontal annular grooves.

Statement 10. The acoustic isolator of any preceding statements 1-4, 6, or 8, further comprising a plurality of annular grooves.

Statement 11. The acoustic isolator of statement 10, wherein at least one of the plurality of annular grooves are disposed between each of the one or more annular chambers.

Statement 12. The acoustic isolator of statement 10, wherein a distance between each of the plurality of annular grooves is from about 0.3" to about 2".

Statement 13. The acoustic isolator of statement 10, wherein a distance between each of the plurality of annular grooves varies between each of the plurality of annular grooves.

Statement 14. The acoustic isolator of any preceding statements 1-4, 6, 8, or 10, wherein the annular groove is filled with a material.

Statement 15. The acoustic isolator of statement 14, the material is a plastic, a rubber, tungsten, or a rubber composite.

Statement 16. A method may comprise transmitting an acoustic wave from a transmitter disposed on an acoustic logging tool into a subterranean formation, receiving an acoustic signal from the subterranean formation with a receiver disposed on the acoustic logging tool, and attenuating a second acoustic wave that moves between the transmitter and the receiver and through an acoustic isolator. The acoustic isolator may comprise a body, one or more annular chambers formed inside the body of the acoustic isolator and positioned along a longitudinal axis of the acoustic isolator, an annular groove formed on an outer surface of the body of the acoustic isolator, and a passage disposed between the one or more annular chambers and the annular groove.

Statement 17. The method of statement 16, wherein the passage is a zigzag passage between the one or more annular chambers and the annular groove.

Statement 18. The method of any preceding statements 16 or 17, wherein the annular groove is disposed between a first annular chamber and a second annular chamber.

Statement 19. The method of any preceding statements 17 or 18, wherein the annular groove is disposed between a first end of the acoustic isolator and the one or more annular chambers.

Statement 20. The method of statement 19, wherein the annular groove is disposed between a second end of the acoustic isolator and the one or more annular chambers.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. An acoustic isolator comprising:

a body;

one or more annular chambers formed inside the body of the acoustic isolator and positioned along a longitudinal axis of the acoustic isolator, wherein each annular chamber has a width from about 0.25 centimeters to about 5 centimeters;

a plurality of annular grooves formed on an outer surface of the body of the acoustic isolator, wherein a distance between each annular groove is from about 0.75 centimeters to about 5 centimeters, wherein each annular groove has a depth ranging from about 0.25 centimeters to about 8 centimeters and a width from about 0.25 cm to about 8 cm, and wherein a spacing between at least one of the one or more annular chambers and at least one of the annular grooves is between about 0.25 centimeters to about 5 centimeters; and a passage disposed between the one or more annular chambers and the plurality of annular grooves, wherein the passage is operable to attenuate an acoustic signal having a frequency between 10 kHz and 50 kHz.

2. The acoustic isolator of claim 1, wherein the passage is a zigzag passage between the one or more annular chambers and the at least one annular groove.

3. The acoustic isolator of claim 1, wherein the at least one annular groove is disposed between a first annular chamber and a second annular chamber.

4. The acoustic isolator of claim 1, wherein the at least one annular groove is disposed between a first end of the acoustic isolator and the one or more annular chambers.

5. The acoustic isolator of claim 4, wherein the at least one annular groove is disposed between a second end of the acoustic isolator and the one or more annular chambers.

6. The acoustic isolator of claim 1, wherein the annular groove is perpendicular to the outer surface of the body of the acoustic isolator.

7. The acoustic isolator of claim 6, wherein the plurality of annular grooves comprises one or more horizontal annular grooves.

8. The acoustic isolator of claim 1, wherein the at least one annular groove is angled to the outer surface of the of the body of the acoustic isolator.

9. The acoustic isolator of claim 8, wherein the plurality of annular grooves comprises one or more horizontal annular grooves.

10. The acoustic isolator of claim 1, wherein the plurality of annular grooves is filled with a material.

11. The acoustic isolator of claim 10, the material is a plastic, a rubber, tungsten, or a rubber composite.

12. The acoustic isolator of claim 1, wherein the passage is operable to attenuate the acoustic signal by more than 30 decibels.

13. The acoustic isolator of claim 1, wherein a distance between each of the plurality of annular grooves varies between each of the plurality of annular grooves.

14. A method, comprising:

transmitting an acoustic wave from a transmitter disposed on an acoustic logging tool into a subterranean formation;

receiving an acoustic signal from the subterranean formation with a receiver disposed on the acoustic logging tool; and attenuating a second acoustic wave that moves between the transmitter and the receiver and through an acoustic isolator, wherein the acoustic isolator comprises:

a body;

one or more annular chambers formed inside the body of the acoustic isolator and positioned along a longitudinal axis of the acoustic isolator, wherein each annular chamber has a width from about 0.25 centimeters to about 5 centimeters;

a plurality of annular grooves formed on an outer surface of the body of the acoustic isolator, wherein a distance between each annular groove is from about 0.75 centimeters to about 5 centimeters, wherein each annular groove has a depth ranging from about 0.25 centimeters to about 8 centimeters and a width from about 0.25 cm to about 8 cm, and wherein a spacing between at least one of the one or more annular chambers and at least one of the annular grooves is between about 0.25 centimeters to about 5 centimeters; and a passage disposed between the one or more annular chambers and the plurality of annular grooves, wherein the passage is operable to attenuate an acoustic signal having a frequency between 10 kHz and 50 kHz.

15. The method of claim 14, wherein at least one annular groove is disposed between a first end of the acoustic isolator and the one or more annular chambers.

16. The method of claim 15, wherein at least one annular groove is disposed between a second end of the acoustic isolator and the one or more annular chambers.

17. The method of claim 14, wherein the passage is a zigzag passage between the one or more annular chambers and at least one annular groove.

18. The method of claim 14, wherein at least one annular groove is disposed between a first annular chamber and a second annular chamber.

* * * * *